US005422616A

United States Patent [19]

Jackman

[11] Patent Number: 5,422,616

[45] Date of Patent: Jun. 6, 1995

[54] ELECTRIC SWITCH

[75] Inventor: Peter R. Jackman, Long Sutton, England

[73] Assignee: First Inertia Switch Limited, Hampshire, England

[21] Appl. No.: 885,872

[22] Filed: May 20, 1992

[30] Foreign Application Priority Data

May 20, 1991 [GB] United Kingdom ..... 9110863

[51] Int. Cl.[6] ..... H01H 9/00

[52] U.S. Cl. ..... 335/205; 335/207; 361/88

[58] Field of Search ..... 335/205–207, 335/151; 361/88, 91, 102, 111, 117, 56, 54

[56] References Cited

U.S. PATENT DOCUMENTS 4,222,020 9/1980 Jameel et al. ..... 335/151
4,228,412 10/1980 Dalley et al. ..... 335/151
4,286,241 8/1981 Olivenbaum et al. ..... 335/151
4,965,416 10/1990 Bachmann ..... 335/207
5,019,795 5/1991 Patel et al. ..... 335/205

*Primary Examiner*—Lincoln Donovan
*Attorney, Agent, or Firm*—Larson & Taylor

[57] ABSTRACT

An electric switch 11 has contacts 12 and 13 which are initially closed by activating means 14. The invention provides urging means 22 to bias the switch against reopening of the contacts during at least an initial period which is useful if the activating means does not operate for long enough for the electric switch to assume its stable closed position. The urging means is responsive to current carried through the contacts. It is possible to provide a plurality of switches responsive to the same urging means, different switches being provided for different electrical circuits and possibly energised from different sources.

9 Claims, 1 Drawing Sheet

ELECTRIC SWITCH

Figure 1:
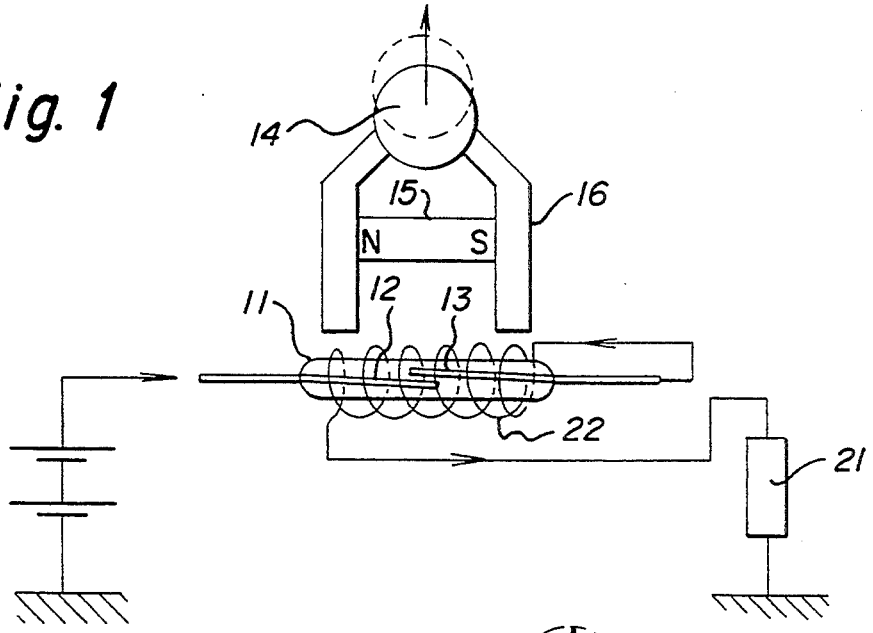

Problems are often encountered with electrical switches in keeping the contacts in the closed state once they have been moved to that state from the open state. Contacts are found to bounce apart once they have been closed and this may reduce the current carrying capacity of the switch and even may cause sparking between the contacts with consequent reduction in life. The agency which causes the switch to close may be very short in time and so some form of latching may be required, at least for a predetermined period of time to ensure that the switch passes a sufficient current for a sufficient time to achieve its desired function.

The invention provides a switch comprising a pair of contacts having an open state and a closed state, means for activating the switch to move the contacts from the open state to the closed state and means responsive to the current carried through the contacts to bias the contacts against opening.

When the invention is applied to a magnetic reed switch, the urging means may comprise a coil around the contacts and carrying the current supplied through the contacts to apply a magnetic field to the reed switch to bias it against opening of the contacts.

Two reed switches may be provided, each subject to the same activating means. In one arrangement, the two switches may simply be connected in parallel; this increases the current-carrying capacity of the switch assembly. In another arrangement, one switch may be connected to the urging means and the other to the load; this is convenient if the current required for the load is very different from that required for the urging means. In either arrangement, the two switches may be connected to the same energising source, or the reed switch connected to the load may be energised by a main energising source while the other, connected to the urging means, may be driven by a supplementary source and this supplementary source may be a capacitor trickle charged by a battery and a resistance. When the capacitor is charging, the battery current is arranged to be insufficient to activate the urging means, but when the capacitor is allowed to discharge, its discharge current is arranged to be sufficient to activate the urging means. With this arrangement, the contacts close at least momentarily in response to the activating means and the momentary closure of the contacts causes the capacitor to discharge, thus activating the urging means to keep the contacts of the switch assembly closed during the discharge of the capacitor. The period of discharge is governed by the values of the capacitants and resistance and is arranged to be long enough to cover the period while there is any tendency for the contacts to bounce apart. Once the switch contacts have reached a stable state, then the urging means is no longer required to be energised and no energy is wasted in keeping the urging means energised.

Figure 2:
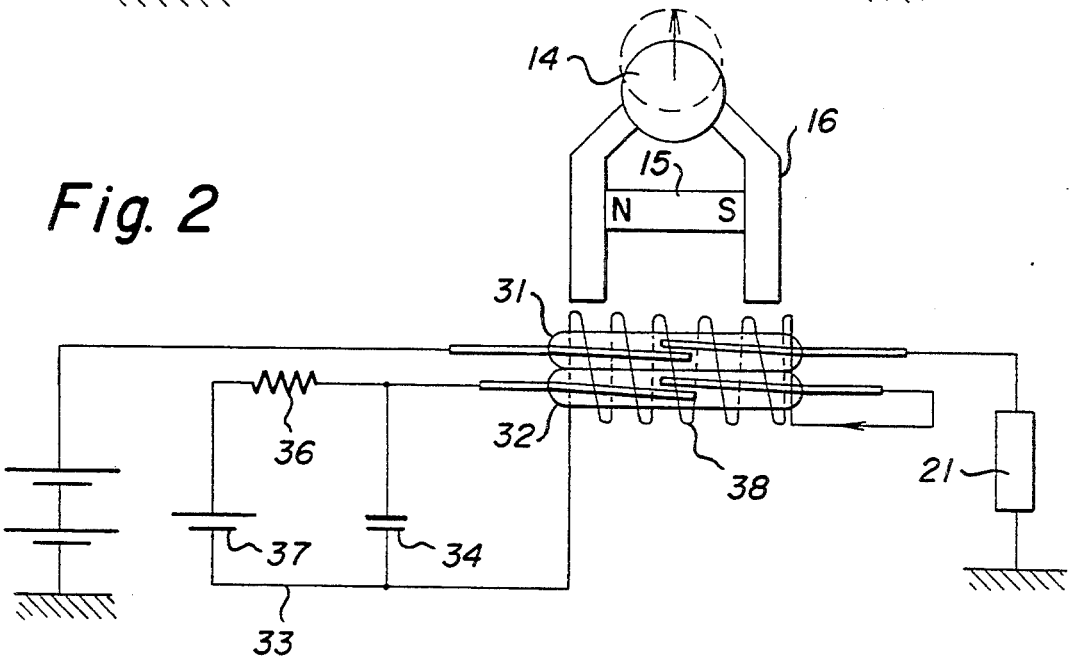
Figure 3:
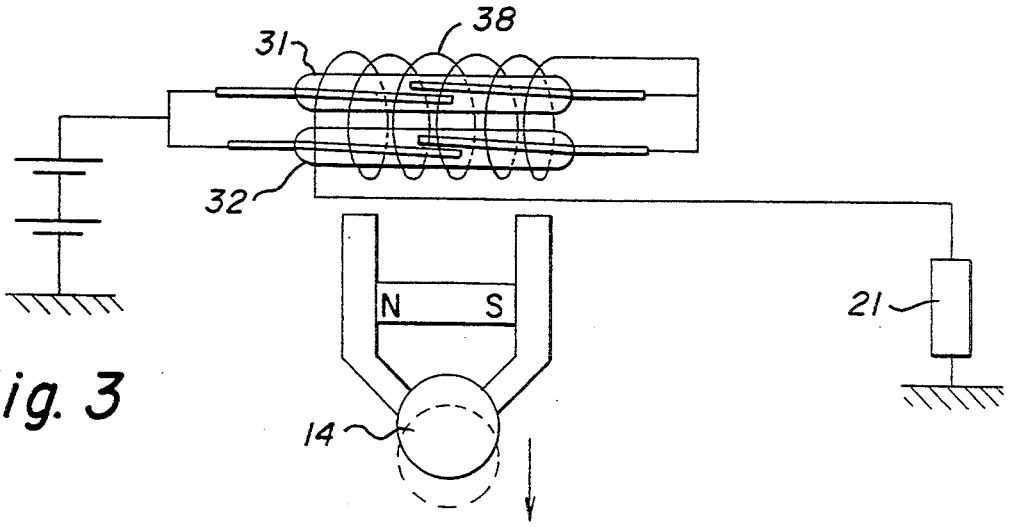

Examples of the invention will now be described with reference to the accompanying drawings in which:

FIGS. 1 to 3 are circuit diagrams of different embodiments of an electrical switch. FIG. 1 shows an embodiment using one reed switch to carry the load. FIG. 2 shows an embodiment using two reed switches, one of which carries the load current. FIG. 3 shows an embodiment using two reed switches in parallel to carry the load current.

The activating means in each of the embodiments comprises a permanent magnet 15 arranged as the crosspiece of an H-shaped core 16. Across one pair of ends of the core 16 an inertia body 14 of magnetic material is located and in the rest position of the body 14, the main magnetic circuit flows from one pole of the permanent magnet 15 through the core 16 and the body 14 back to the other pole of the magnet 15. A reed switch assembly 10 is arranged across the other pair of ends of the core. Very little magnetic flux flows through the reed switch assembly 10 when the body 14 is in position.

If the apparatus is subjected to a sufficient acceleration to dislodge the inertia body 14 from its rest position, it will break the low reluctance magetic flux path between the first pair of ends of the core, causing a very much higher flux to flow through the magnetic reed asssembly 10 and this higher flux will cause the contacts 12 and 13 of the reed switch 11 to close at least momentarily.

When the contacts 12 and 13 close, a current flows through them to energise the load 21. If the component 14 is only momentarily moved away or if the contacts 12 and 13 tend to bounce apart once they are closed, the current which is supplied to the load may not be sufficient to cause the load to operate and the switch will then not be effective in responding to the movement of the component 14. The apparatus therefore provides a positive feedback to the increase of flux through the reed switch by providing a coil 22 around the reed switch which coil carries the current to the load which has passed through the contacts 12 and 13. The coil generates a magnetic field which reinforces the flux passing through the switch and so keeps the contacts closed once they have been brought together in response to the movement of the component 14. The switch is therefore self-latching and once the component has even momentarily moved the switch remains closed and the load remains activated.

In the embodiment of FIG. 2, two parallel reed switches 31, 32 are provided, the first 31 for carrying the load current and the second 32 being energised by a separate circuit 33 which has a capacitor 34 trickle charged by means of a resistor 36 and battery 37. When the component 14 moves, the magnetic flux passing through both switches causes their contacts to close. The closed contacts of the first switch energise the load and those of the second switch provide a discharge path for the capacitor 34 and the discharge current from the capacitor passes around the coil 38 which reinforces the flux keeping the contacts closed. When the capacitor 34 is discharged, it is recharged through the trickle charger including the battery 37, but the current from the battery 37 is insufficient to generate a magnetic flux sufficient to keep the switches 31, 32 closed once the component 14 has been returned to the magnetic path around the switch. With the arrangement of FIG. 2 therefore the contacts are only kept closed during the discharge period of the capacitor after which return of the component 14 to its rest position will allow the contacts to reopen since the coil 38 is then insufficiently energised to keep the contacts closed. The arrangement of FIG. 2 thus provides a latching circuit which does not latch for ever but only until the component 14 has returned and for a predetermined period after initial closure of the contacts. This arrangement has the advantage that the load current is independent of the current in coil 38 used to provide the reinforcing flux.

When a single reed switch is of insufficient capacity to carry the full current load, or to provide increased redundancy, it is convenient to provide two reed switches in parallel between the power source and the load to be energised, as shown in FIG. 3. This arrangement has problems in that it is difficult to match the switches perfectly and difficulties may be encountered when one switch operates before the other in response to the movement of the component 14. The addition of the urging coil around both switches ensures that as soon as one switch starts to conduct, the reinforcing field from the coil encircling the switches will ensure that the other switch operates with a much smaller delay than if the coil had not been present.

In the drawings, the windings of the coils are diagrammatic only. The coils are wound in such direction as to reinforce the change of field at the switch due to the movement of the component 14. When the component 14 moves, the field at the switch changes so as to cause the contacts of the switch or switches to close and the current then carried between the contacts causes the current to flow in the coil which reinforces the change of magnetic field which initiated the closing of the contacts.

In the embodiments so far described, the activating means activates the reed switch by movement of the inertia body 14 relative to a stationary magnetic core. It would be possible to activate the reed switch 11 by making the magnetic core itself move relative to the reed switch in response to the applied acceleration. The basic requirement for this invention is that the initial closure of the contacts of the electric switch should be made by activating means and that the contacts are biased against reopening at least for an initial period of time by the urging means.

I claim:

1. A switch assembly comprising a pair of contacts having an open state and a closed state, means for activating the switch to move the contacts from the open state to the closed state and biasing means responsive only to only the current carried through the contacts providing positive reinforcement of the activation means for biasing the contacts against opening activation means for biasing the contacts against opening.

2. A switch assembly as claimed in claim 1 wherein the pair of contacts form part of a magnetic reed switch, the biasing means comprising a coil around contacts and connected in series with the contacts to create a magnetic field to the reed switch to urge the reed switch towards its closed state.

3. A switch assembly claimed in claim 2 wherein two said reed switches are provided, each responsive to the same activating means.

4. An assembly as claimed in claim 3 wherein the two switches are connected in parallel.

5. An assembly as claimed in claim 3 wherein one said switch is connected in series with the biasing means and the other said switch is connected to a load.

6. An assembly as claimed in claim 4 wherein said switches are connected to the same source for energisation.

7. An assembly as claimed in claim 4 wherein one said switch is connected to a main energising source and connects a load to the energising source and the other said switch is connected to a supplementary energising circuit.

8. An assembly as claimed in claim 7 wherein the supplementary energising circuit comprises a trickle charged capacitor which can be discharged through the biasing means on closure of the switch.

9. An assembly as claimed in claim 8 wherein the activating means comprises a magnetic flux circuit including an inertia body of magnetic material which is moved relative to the remainder of the magnetic flux circuit in response to an acceleration, thus causing a variation of the magnetic flux elsewhere in the magnetic circuit.

* * * * *